US006102004A

United States Patent [19]

Cowden et al.

[11] Patent Number: 6,102,004

[45] Date of Patent: Aug. 15, 2000

[54] ELECTRONIC CONTROL FOR A HYDRAULICALLY ACTIVATED, ELECTRONICALLY CONTROLLED INJECTOR FUEL SYSTEM AND METHOD FOR OPERATING SAME

[75] Inventors: Gary L. Cowden, Morton; Errol W. Davis; Brian G. McGee, both of Chillicothe; Daniel R. Puckett; Matthew E. Schulman, both of Peoria; John P. Timmons, Chillicothe, all of Ill.

[73] Assignee: Caterpillar, Inc., Peoria, Ill.

[21] Appl. No.: 08/995,248

[22] Filed: Dec. 19, 1997

[51] Int. Cl.[7] ..... F02M 3/00

[52] U.S. Cl. ..... 123/446; 123/381

[58] Field of Search ..... 123/446, 458, 123/447, 381, 456

[56] References Cited

U.S. PATENT DOCUMENTS

| | | | |
|---|---|---|---|
| 4,343,280 | 8/1982 | Luscomb | 123/459 |
| 4,534,332 | 8/1985 | Eheim et al. | 123/502 |
| 4,765,587 | 8/1988 | Cummins | 251/129.19 |
| 4,840,155 | 6/1989 | Karle | 123/300 |
| 4,892,286 | 1/1990 | Reinicke et al. | 251/129.11 |
| 4,919,497 | 4/1990 | Kaes | 303/119 |
| 4,922,878 | 5/1990 | Shinogle et al. | 123/490 |
| 4,997,004 | 3/1991 | Barkhimer | 137/596.17 |
| 5,000,421 | 3/1991 | Hendrixon et al. | 251/129.08 |
| 5,150,688 | 9/1992 | Nothdurft et al. | 123/506 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,357,912 | 10/1994 | Barnes et al. | 123/357 |
| 5,359,883 | 11/1994 | Baldwin et al. | 73/117.3 |
| 5,447,138 | 9/1995 | Barnes | 123/446 |
| 5,492,098 | 2/1996 | Hafner et al. | 123/446 |
| 5,492,099 | 2/1996 | Maddock | 123/446 |
| 5,564,391 | 10/1996 | Barnes et al. | 123/446 |
| 5,586,538 | 12/1996 | Barnes | 123/446 |
| 5,601,067 | 2/1997 | Wirbeleit | 123/446 |
| 5,611,317 | 3/1997 | Peters | 123/446 |
| 5,687,693 | 11/1997 | Chen | 123/446 |
| 5,730,104 | 3/1998 | Hafner | 123/446 |
| 5,743,234 | 4/1998 | Nemoto | 123/446 |
| 5,826,562 | 10/1998 | Chen | 123/446 |

*Primary Examiner*—Carl S. Miller
*Attorney, Agent, or Firm*—R. Carl Wilbur

[57] ABSTRACT

An apparatus and method for varying the current levels of a fuel injection signal used in connection with an electronically controlled hydraulic actuator unit injector fuel system is disclosed. The apparatus and method varies the current level of the fuel injection signal delivered to the unit injector based on sensed engine parameters, which preferably include a sensed pressure of hydraulic actuating fluid and a sensed temperature of the engine.

6 Claims, 3 Drawing Sheets

110
122
127
25
132
112
180
$S_1$
$S_1$
185
138
136
127
$S_9$
$S_1$
$S_2$
$S_3$
$S_4$
$S_5$
$S_6$
$S_7$
$S_8$
111
$S_{10}$
140
174
130
128
126
133
120
114
114
144
148
146
147
149
144
124
116
142
118

ELECTRONIC CONTROL FOR A HYDRAULICALLY ACTIVATED, ELECTRONICALLY CONTROLLED INJECTOR FUEL SYSTEM AND METHOD FOR OPERATING SAME

A hydraulically-actuated piston and barrel assembly includes a barrel defining an actuation fluid cavity and a piston bore, which includes an upper bore and a lower bore. A stepped piston is slidably received in the piston bore and moveable between a retracted position and an advanced position. The stepped top of the piston includes a first area that is separate from a second area. The first area and the upper bore define an upper cavity connected to the actuation fluid cavity through a relatively unrestricted flow area, when the piston is in its retracted position. The second area and the lower bore define a lower cavity connected to the actuation fluid cavity through a relatively restricted flow area when the piston is in its retracted position. The first area is exposed to fluid pressure in the upper cavity and the second area is exposed to fluid pressure in the lower cavity over a portion of the piston's movement from its retracted position toward its advanced position. One of the piston or the barrel, or both, further define a restricted passage that includes a restricted flow area connecting the actuation fluid cavity to the lower cavity. The disclosure also includes a description of a hydraulically-actuated fuel injector that incorporates the piston and barrel assembly described above.

DESCRIPTION

Technical Field

The present invention relates generally to hydraulically actuated electronically controlled fuel injection, and more particularly, to an electronic control for varying the current levels of a fuel injection signal based on sensed engine parameters.

Background Art

Electronically controlled fuel injectors are well known in the art. An example of a hydraulically actuated electronically controlled unit injector fuel system is shown in U.S. Pat. No. 5,191,867 issued to Glassey on Mar. 9, 1993.

As is known in the art, to control the power and emissions output of an internal combustion engine precisely, it is necessary to control the timing and quantity of fuel injected into the engine cylinders. Electronically controlled fuel injectors typically inject fuel into a specific engine cylinder as a function of an injection signal received from an electronic controller. When using hydraulically actuated electronically controlled unit injectors (hereinafter referred to as "HEUI injectors"), the injection signal includes generally a two-tier current waveform that includes a pull-in current level and a generally lower hold-in current level. An example of such a fuel injection signal is disclosed in U.S. Pat. No. 5,564,391 issued to Barnes et al. The higher pull-in current is used to quickly open the fuel injector and thereby decrease the response time (i.e., the time between the initiation of a fuel injection signal and the time at which fuel actually begins to enter the engine cylinder). Once fuel injection has commenced, a lower level hold-in current can be used to hold the injector open for the remainder of the injection cycle.

In general, it is desirable to decrease the response time of the injector. Higher pull-in current levels will generally decrease the response time. However, current levels that are too high will result in undesirable consequences. For example, when the pull-in current level is too high, both the fuel injector solenoid and the driver circuit electrical components must be able to withstand the higher power levels must be able to dissipate the greater dissipated heat. As is described in more detail below, higher current levels can also create undue stress on mechanical components of the injector and also degrade its repeatability. Higher power components and/or more robust mechanical components will increase the cost of the injector driver design. The degraduation of the injector repeatability will adversely affect injector performance.

Typically, therefore, the pull-in current level is a pre-selected value that provides sufficiently fast injection response under the most severe injector operating conditions. However, that pre-selected pull-in current value may be more current than is required to provide the desired response in other, less severe, operating conditions. It would be preferable to have a system capable of providing a sufficient response time without requiring higher power components and without unduly stressing the mechanical components.

DISCLOSURE OF THE INVENTION

The present invention includes an electronic control system used in connection with a compression ignition engine. The engine has a hydraulically actuated electronic unit fuel injector connected to a source of high pressure actuating fluid. Included is an electronic controller connected to the fuel injector. A pressure sensor is used to sense the pressure of the high pressure actuating fluid. The electronic controller produces a fuel injection signal that is, in part, a function of the pressure signal.

These and other aspects and advantages of the present invention will become apparent upon reading the detailed description in connection with the drawings and appended claims.

DETAILED DESCRIPTION OF THE BEST MODE FOR CARRYING OUT THE INVENTION

Figure 1:
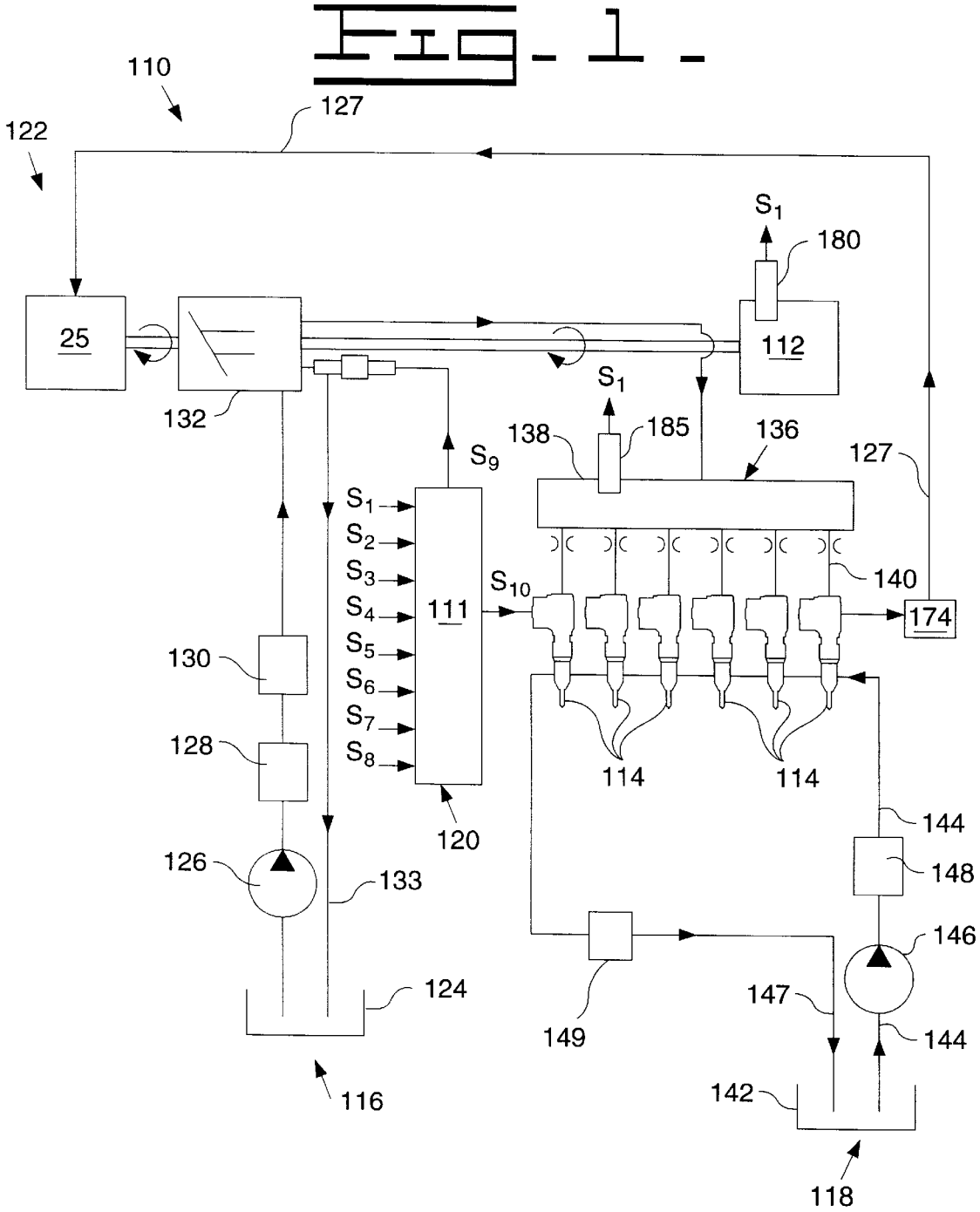
FIG. 1 is a schematic view of a fuel injection system used in connection with a preferred embodiment of the invention.

Referring now to FIG. 1, there is shown an embodiment of a hydraulically-actuated electronically-controlled fuel injection system 110 in an example configuration as adapted for a direct-injection diesel-cycle internal combustion engine 112. Fuel system 110 includes one or more hydraulically-actuated electronically-controlled fuel injectors 114, which are adapted to be positioned in a respective cylinder head bore of engine 112. Fuel system 110 includes an apparatus or means 116 for supply actuating fluid to each injector 114, an apparatus or means 118 for supplying fuel to each injector, a computer 120 for electronically controlling the fuel injection system and an apparatus or means 122 for re-circulating actuation fluid and for recovering hydraulic energy from the actuation fluid leaving each of the injectors.

The actuating fluid supply means 116 preferably includes an actuating fluid sump 124, a relatively low pressure actuating fluid transfer pump 126, an actuating fluid cooler 128, one or more actuation fluid filters 130, a high pressure pump 132 for generating relatively high pressure in the actuation fluid and at least one relatively high pressure actuation fluid manifold 136. A common rail passage 138 is arranged in fluid communication with the outlet from the relatively high pressure actuation fluid pump 132. A rail branch passage 140 connects the actuation fluid inlet of each injector 114 to the high pressure common rail passage 138.

Actuation fluid leaving an actuation fluid drain of each injector 114 enters a re-circulation line 127 that carries the same to the hydraulic energy re-circulating or recovering means 122. A portion of the re-circulated actuation fluid is channeled to high pressure actuation fluid pump 132 and another portion is returned to actuation fluid sump 124 via re-circulation line 133.

In a preferred embodiment, the actuation fluid is engine lubricating oil and the actuation fluid sump 124 is an engine lubrication oil sump. This allows the fuel injection system to be connected as a parasitic subsystem to the engine's lubricating oil circulation system.

The fuel supply means 118 preferably includes a fuel tank 142, a fuel supply passage 144 arranged in fluid communication between fuel tank 142 and the fuel inlet of each injector 114, a relatively low pressure fuel transfer pump 146, one or more fuel filters 48, a fuel supply regulating valve 149, and a fuel circulation and return passage 147 arranged in fluid communication between injectors 114 and fuel tank 142.

The computer 120 preferably includes an electronic control module 111 including a microprocessor and memory. As is known to those skilled in the art, the memory is connected to the microprocessor and stores an instruction set and variables. Associated with the microprocessor and part of the electronic control module 111 are various other known circuits such as power supply circuitry, signal conditioning circuitry and solenoid driver circuitry, among others. The electronic control module 111 controls 1) the fuel injection timing; 2) the total fuel injection quantity during an injection cycle; 3) the fuel injection pressure; 4) the number of separate injections or injection segments during each injection cycle; 5) the time intervals between the injection segments; 6) the fuel quantity of each injection segment during an injection cycle; 7) the actuation fluid pressure; 8) current level of the injector waveform; and 9) any combination of the above parameters. Computer 120 receives a plurality of sensor input signals $S_1$–$S_8$, which correspond to known sensor inputs, such as engine operating conditions including engine temperature, pressure of the actuation fluid, load on the engine, etc., that are used to determine the precise combination of injection parameters for a subsequent injection cycle.

For example, an engine temperature sensor 180 is shown connected to the engine 112. In one embodiment, the engine temperature sensor includes an engine oil temperature sensor. However, an engine coolant temperature sensor can also be used to detect the engine temperature. The engine temperature sensor produces a signal designated by $S_1$ in FIG. 1 and is input to the computer 120 over line $S_1$. Another example of an engine sensor input is a rail pressure sensor 185 shown connected to the high pressure canopy rail passage 138 for producing a high pressure signal $S_2$ responsive to the pressure of the actuating fluid. The electronic control module 111 inputs the high pressure signal on input $S_2$.

In this example, computer 120 issues control signal $S_9$ to control the actuation fluid pressure and a fuel injection signal $S_{10}$ to energize a solenoid within a fuel injector thereby controlling fluid control valve(s) within each injector 114 and causing fuel to be injected into a corresponding engine cylinder. Each of the injection parameters are variably controllable, independent of engine speed and load. In the case of injector 114, control signal $S_{10}$ is a fuel injection signal that is a computer commanded current to the injector solenoid.

Figure 2:
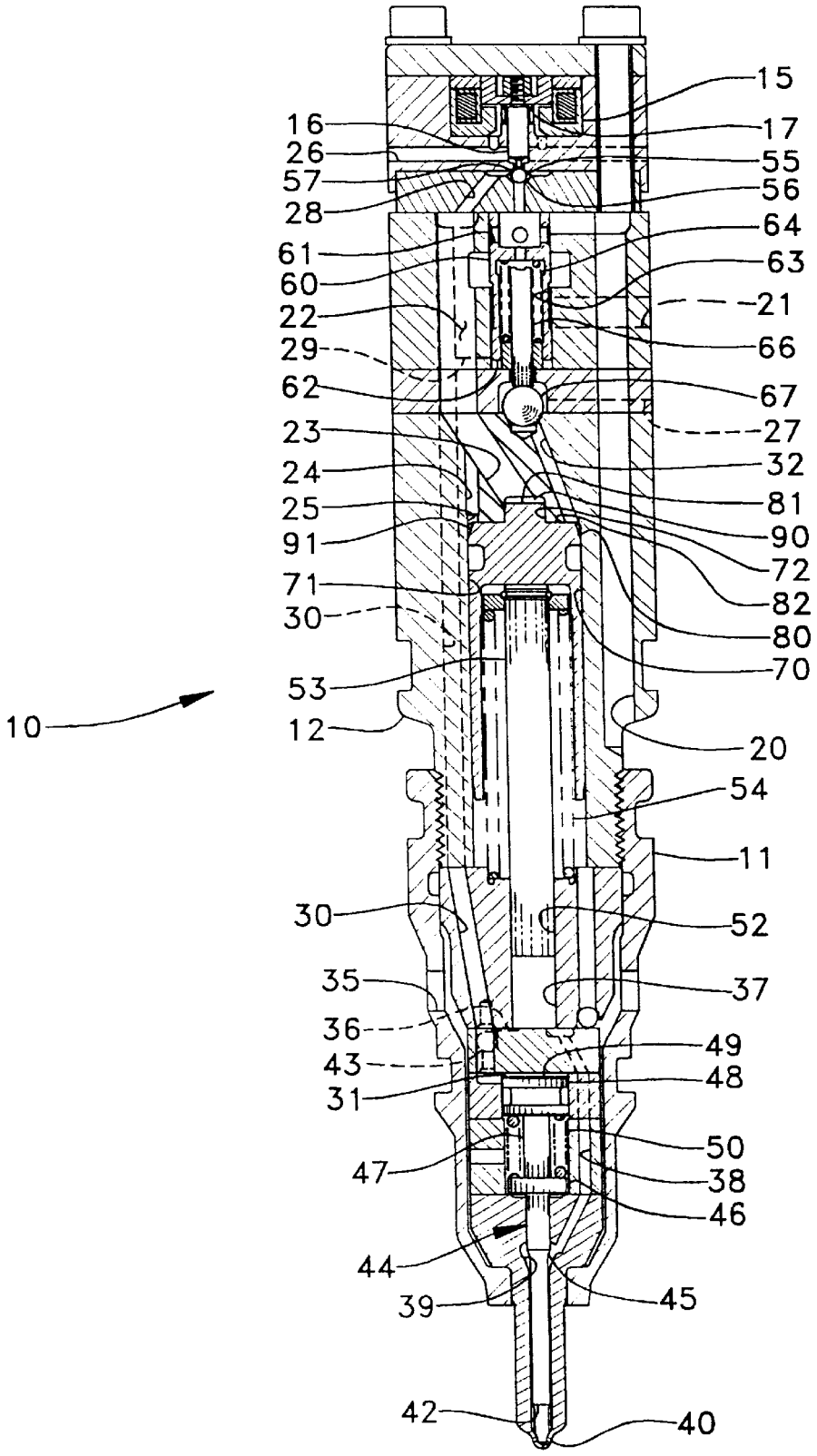
FIG. 2 is a sectioned side elevational view of a preferred embodiment of a hydraulically-actuated fuel injector used in connection with the present invention.

Referring now to FIG. 2, a sectioned side elevational view of a preferred embodiment of a HEUI fuel injector used in connection with the present invention is shown. As is described more fully in co-pending application Ser. No. 8/768014 filed on Dec. 13, 1996, fuel injection is controlled by applying an electrical current in the form of the fuel injection signal to a two-way solenoid 15, which is attached to a pin 16 and biased toward a retracted position by a spring 17. The actuation fluid control valve also includes a ball valve member 55, and a spool valve member 60. Ball valve member 55 is positioned between a high pressure seat 56 and a low pressure seat 57. When solenoid 15 is deactivated, high pressure actuation fluid acting on ball valve member 55 holds the same in low pressure seat 57 to close actuation fluid drain 26. When solenoid 15 is activated, pin 16 moves downward contacting ball valve member 55 and pushing it downward to close high pressure seat 56 and open low pressure seat 57. By actuating the solenoid 15 and seating the ball valve member 55 in the high pressure seat 56, the injector begins to inject fuel. For a more detailed explanation of the preferred embodiment HEUI injector shown in FIG. 2, reference should be made to the above described co-pending U.S. Patent application Ser. No. 8/768014, which is attached hereto as Exhibit A and is incorporated herein as part of the present specification.

Again referring to FIG. 2, it can be see that the response time of a HEUI fuel injector depends, in part, on the time required to move the ball valve member 55 from the low pressure seat 57 to the high pressure seat 56. In general, the response time is partly a function of the electrical current level of the fuel injection signal and the hydraulic force opposing the ball valve member 55.

The magnitude of the electrical current applied to solenoid 15 determines the force the solenoid 15 generates on the pin 16. To begin injecting fuel, the fuel injector current level must, be sufficient to overcome the opposing hydraulic force of the actuation fluid and sufficient to seat the ball valve member 55 in the high pressure seat 56. If the electrical current applied is too little, the solenoid 15 will generate insufficient force either to move the ball valve member 55 from the low pressure seat 57 or insufficient force to seat the ball valve member 55 properly in the high pressure seat 56. In either case the injector would not work properly. On the other hand, if the current is too high, the solenoid 15 will generate too much force on the pin 16, which will thereby move the ball valve member 55 too quickly and cause the ball valve member 55 to impact the high pressure seat 56 with a greater force than desirable. This could cause the ball valve member 55 to bounce in the seat 56, thereby delaying the beginning of fuel injection, and because the delay caused by the bouncing is unpredictable, it would also introduce variability in the fuel injector response time. Furthermore, if the current is too high, it may create a force on the pin 16 which is large enough to cause an impact force of the ball valve member 55 on the seat 56 that could damage the pin 16 and thereby shorten the working life of the injector or cause the injector to malfunction.

To move the ball valve member 55 from the low pressure seat 57 to the high pressure seat 56, it is necessary to overcome the opposing force of the actuation fluid. The opposing force of the actuation fluid depends, in part, on: 1) the pressure of the fluid; and 2) the fluid viscosity (which in turn is a function of temperature). Thus, for a constant pull-in current applied to the solenoid, the response time will increase as: 1) the pressure of the actuation fluid increases; and 2) the temperature of the actuation fluid decreases. To maintain a relatively constant response time while reducing overall power requirements and minimizing the impact force generated by seating the ball valve member 55 in the high pressure seat 56, a preferred embodiment of the present invention varies the pull-in current levels as a function of fluid actuation pressure and fluid viscosity. In a preferred embodiment, an engine temperature sensor is used to sense the temperature of the engine and use that measurement as an approximation of the fluid viscosity. In a preferred embodiment, it is possible to use either an engine oil temperature sensor or an engine coolant temperature sensor to determine engine temperature. Although a preferred embodiment of the present invention uses both an engine temperature sensor and an actuation pressure sensor, it should be recognized that in some applications it will be possible to modify the pull-in or hold-in current levels based solely on either actuation pressure or engine temperature without deviating from the scope of the present invention as defined by the appended claims.

Figure 3:
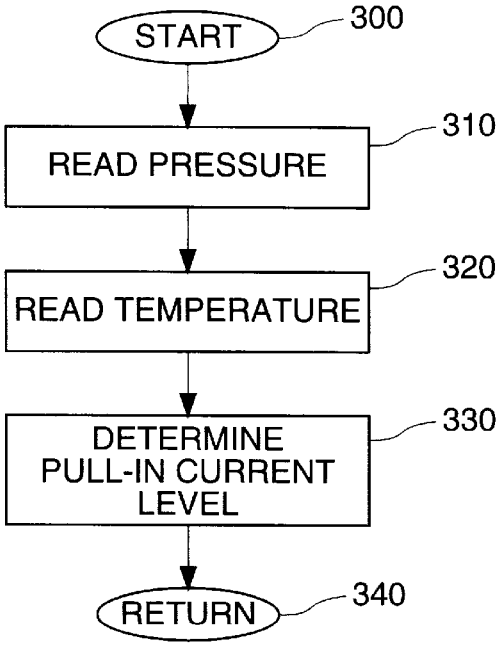
FIG. 3 is a flowchart of software logic implemented in a preferred embodiment is shown.

Referring now to FIG. 3, a flowchart of the software logic used in connection with a preferred embodiment is shown. Those skilled in the art could readily and easily write software implementing the flowchart shown in FIG. 3 using the instruction set, or other appropriate language, associated with the particular microprocessor to be used. In a preferred embodiment, a Motorola MC68336 is used in the electronic controller 111. However, other known microprocessors could be readily and easily used without deviating from the scope of the present invention.

Block 300 begins the program control. Program control passes from block 300 to block 310. In block 310, the controller 111 reads the pressure of the actuation fluid. In a preferred embodiment, the rail pressure sensor 185 is an analog sensor that continuously produces an output signal on line S2. That signal is a function of the pressure of the actuation fluid. Typically, well-known signal conditioning and other input currently are also included. The electronic controller 111 reads the pressure signal periodically and places the value in memory for later use by this and other portions of the control software. In a preferred embodiment, the sampling rate of the pressure sensor is a function of engine speed and other known factors. Typically, the pressure sensor 185 is sampled at a rate greater than once per control loop. In block 310, the preferred embodiment reads the pressure value stored in memory. It should be recognized that there are other ways of providing the controller 111 with the pressure value that would be used without deviating from the scope of the present invention from block 310 program control then passes to block 320.

In block 320, the electronic controller 111 reads a temperature signal produced by the engine temperature sensor 180. In a preferred embodiment, the engine temperature signal is an analog signal produced by a coolant temperature sensor or an engine oil temperature sensor, but could be based on another sensed temperature. The electronic controller periodically inputs the engine temperature signal over input $S_2$ and stores that value in memory. In a preferred embodiment, the controller 111 reads the engine temperature sensor once every eighth control loop and stores that value in memory. However, other sampling frequencies could be readily and easily used without deviating from the present invention as defined by the appended claims. In block 320, the controller 111 reads the memory location that stores the engine temperature value. Program control then passes to block 330.

Figure 4:
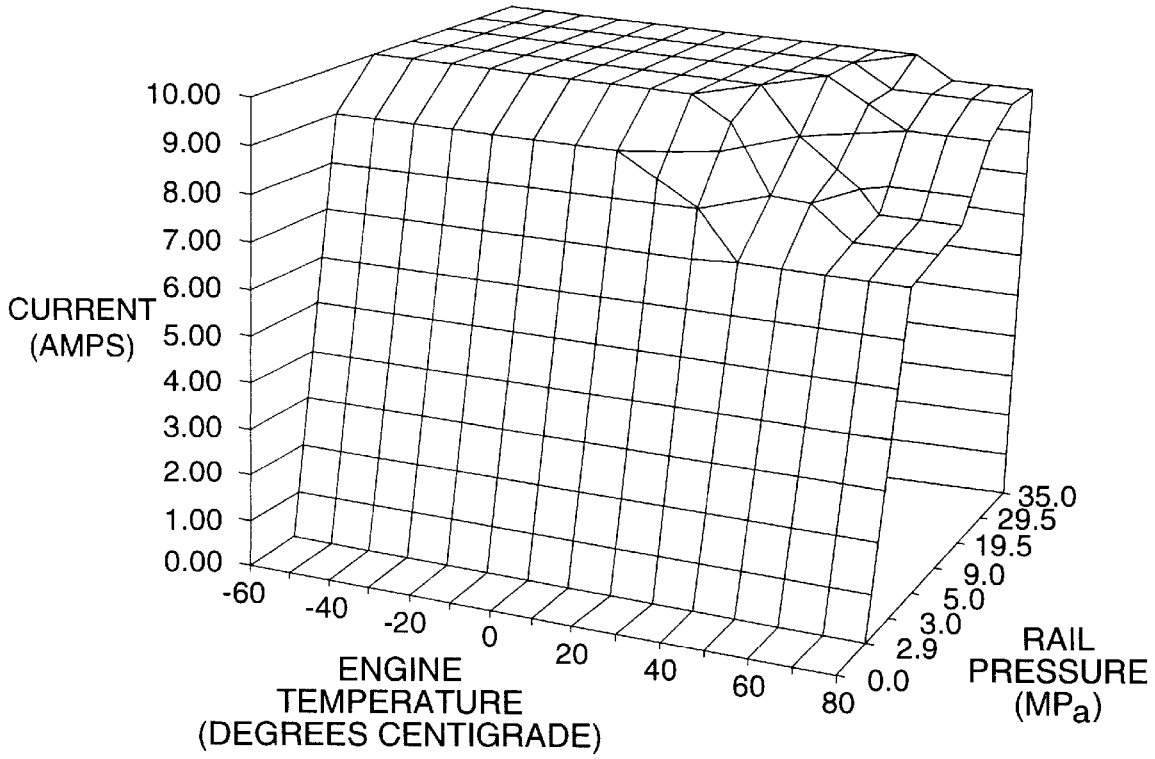
FIG. 4 is a generic map of the type used in connecting with a preferred embodiment of the present invention.

In block 330, the electronic controller 111 determines an appropriate pull-in current level based on the actuation pressure and engine temperature. In a preferred embodiment, the electronic controller 111 accesses a look up table to determine the pull-in current value. As is known to those skilled in the art, an interpolation algorithm is used to calculate pull-in current when the measured engine temperature or measured actuation pressure lies between two adjacent table entries. FIG. 4, described in more detail below, shows a graphical representation of such a look up table. Other methods for calculating a pull-in, such as through the use of a formula, could be used without deviating from the scope of the present invention as defined by the present claims. Program control then passes to block 340.

In block 340, program control returns to the main program where the electronic controller 111 uses the pull-in current level determined in block 330 to develop the injection signal delivered to the injectors over the control line $S_{10}$. The logic of FIG. 3 is performed every control loop to help insure that the pull-in current is as close as possible to the current actually required to produce the expected fuel injector response time.

Referring now to FIG. 4 a generic graphical map of the type that is used in a preferred embodiment of the invention is shown. The map is a graphical representation of the look up table referenced in block 330. As can be seen in the figure, as the actuation pressure increases, the pull-in current required to move the ball valve member 55 from the low pressure seat 57 to the high pressure seat 56 increases. Likewise, since the actuation fluid's viscosity increases as the engine temperature decreases, the current level required to overcome the force of the actuation fluid increases as the temperature decreases. The specific values in a look up table and on the corresponding map are a function of the specific injector, the specific actuation fluid, and the engine used, among other factors. Although FIG. 4 represents the preferred current levels used in connection with an embodiment of the HEUI injector shown in FIG. 2 the present invention is not limited to that specific table nor to those specific current levels. To the contrary, it is expected that the current levels may be different for different fuel injectors and actuation fluids, among other factors. The use of different pull-in current values than shown in FIG. 4 would nevertheless fall within the scope of the present invention as defined by the appended claims.

What is claimed is:

1. An electronic control system for use with a compression ignition engine having a hydraulically actuated electronic unit fuel injector connected to a source of high pressure actuating fluid, said electronic control system comprising:

an electronic controller electrically connected to said hydraulically actuated electronic unit fuel injector;

a pressure sensor associated with said high pressure actuating fluid, said pressure sensor electrically connected to said electronic controller and producing a pressure signal responsive to a pressure of said high pressure actuating fluid;

wherein said electronic controller calculates a fuel injection signal as a function of said pressure signal and delivers said fuel injection signal to said hydraulically actuated electronic unit fuel injector; and wherein said electronic controller varies a current level of said fuel injection signal in response to said pressure signal.

2. An electronic control system for use with a compression ignition engine having a hydraulically actuated electronic unit fuel injector connected to a source of high pressure actuating fluid, said electronic control system comprising:

an electronic controller electrically connected to said hydraulically actuated electronic unit fuel injector;

an engine temperature sensor producing a signal responsive to a temperature of said engine;

wherein said electronic controller delivers a fuel injection signal to said hydraulically actuated electronic unit fuel injector as a function of said temperature signal; and wherein said electronic controller varies a current level of said fuel injection signal in response to said temperature signal.

3. An electronic control system for use with a compression ignition engine having a hydraulically actuated electronic unit fuel injector connected to a source of high pressure actuating fluid, said electronic control system comprising:

an electronic controller electrically connected to said hydraulically actuated electronic unit fuel injector;

a pressure sensor associated with said high pressure actuating fluid, said pressure sensor electrically connected to said electronic controller and producing a pressure signal responsive to a pressure of said high pressure actuating fluid;

an engine temperature sensor producing a signal responsive to a temperature of said engine;

wherein said electronic controller delivers a fuel injection signal including a pull-in current level and a hold-in current level to said hydraulically actuated electronic unit fuel injector as a function of said pressure signal and said signal responsive to the temperature of the engine; and wherein said pull-in current level of said fuel injection signal is a function of said pressure signal and said signal responsive to the temperature of the engine.

4. The electronic control system of claim 3, including a memory device associated with said electronic controller, said memory device having a map stored therein correlating a pull-in current value to a specific pressure signal and signal responsive to the temperature of the engine.

5. A method of controlling fuel delivery to a compression ignition engine having an electronic controller, a hydraulically actuated electronically controlled fuel injector, a source of high pressure actuating fluid, a pressure sensor associated with said high pressure actuating fluid, and an engine temperature sensor, said method comprising:

sensing a pressure of said high pressure actuating fluid;

sensing a temperature of said engine;

determining a current level of a fuel injection signal as a function of said steps of sensing; and delivering said fuell injection signal to said hydraulically actuated electronically controlled fuel injector.

6. The method of claim 5, wherein said step of determining a current level, includes: determining a pull-in current level as a function of said steps of sensing.

* * * * *